United States Patent [19]

Rendall

[11] 4,160,718

[45] Jul. 10, 1979

[54] SOLVENT EXTRACTION PROCESS

[75] Inventor: John S. Rendall, Stanford-le-Hope, England

[73] Assignee: Rohrtil S. A., Lugano, Switzerland

[21] Appl. No.: 821,497

[22] Filed: Aug. 3, 1977

[30] Foreign Application Priority Data

Aug. 7, 1976 [GB] United Kingdom ..... 32989/76
Jan. 25, 1977 [GB] United Kingdom ..... 2939/77

[51] Int. Cl.[2] ..... C10G 1/04
[52] U.S. Cl. ..... 208/11 LE; 196/14.52
[58] Field of Search ..... 208/11 LE; 196/14.52

[56] References Cited

U.S. PATENT DOCUMENTS

| | | | |
|---|---|---|---|
| 1,487,541 | 3/1924 | Coogan | 208/11 LE |
| 1,520,752 | 12/1924 | Horwitz | 208/11 LE |
| 3,846,276 | 11/1974 | Walker | 208/11 LE |

*Primary Examiner*—Herbert Levine
*Attorney, Agent, or Firm*—Bernard & Brown

[57] ABSTRACT

A continuous solvent extraction process for tar-sand uses a closed rotary contactor. A tar-sand/water slurry stream and a solvent stream are passed countercurrent through the contactor and three phases are formed: tar-sand solids at the bottom of the contactor, a barrier layer of water in which the solids are contained and an uppermost solvent phase. The solids during their travel through the contactor are repeatedly lifted off the bottom of the contactor and tumbled through the solvent phase so that the bitumen oils content of the tar-sand is progressively dissolved in the solvent. A solvent stream containing the dissolved bitumen oils is removed from one end of the contactor and discard stream consisting essentially of sand and water is removed from the other end.

26 Claims, 4 Drawing Figures

SOLVENT EXTRACTION PROCESS

This invention relates to a solvent extraction process for the extraction of bitumen oils from tar-sand as found in various areas of the world. Tar-sand is found in the form of particles each of which consists of a nucleus of sand and fines which is wetted and surrounded by water, in turn enclosed by a layer of a mixture of oils, referred to herein as "bitumen oils". The oil content of tar-sand found in Alberta, Canada for example consists of approximately 60% bitumen-like materials, 20% heavy petroleum oils, 18% lighter oils similar to kerosene and naphtha, and 2% gasoline, all percentages being by weight.

There is no great theoretical problem in separating the bitumen oils from the other constituents of tar-sand and indeed one process for doing so is in commercial operation, using hot water to break down the tar-sand particles and separate the bitumen oils. That process is only marginally viable commercially, having a relatively low extraction rate, low efficiency, and high capital and operating costs. In addition, as large quantities of water are to be disposed of, much of it seriously contaminated with oils and other chemicals, the hot water process can be damaging to the environment.

There have also been many theoretical proposals for extracting the bitumen oils with solvents but none of those has been adopted on a commercial scale. Those proposals have moreover required large volumes of solvent, greatly exceeding the extracted bitumen oils on a weight to weight basis, and have necessitated complicated equipment. As the solvent is applied directly to the tar-sand particles, there are high solvent losses because of the retention of solvent by the sand, and there are difficulties in separating the fines from the solvent. Further, the large volumes of solvent required for the process present a fire hazard while the dissemination of solvent vapour is environmentally unacceptable.

The present invention resides in a continuous process for the solvent extraction of bitumen oils from tar-sand, in which process tar-sand is supplied at a supply point to a closed contactor and passed through the contactor towards a discharge point; a stream of solvent is passed through the contactor, the solvent being of lesser density than, and substantially immiscible with, water; water is supplied to the contactor, the solvent stream and the water providing a solvent phase and a water phase in the contactor, which is substantially filled by the solvent phase, the water phase and solids of the tar-sand, with a barrier layer formed by the water phase between the solvent phase and solids; solids of the tar-sand are repeatedly showered through the liquid phases in the contactor as the tar-sand passes through the contactor towards the discharge point, whereby the solids are contacted with the solvent phase and bitumen oils are progressively dissolved in the solvent phase; a bitumen oils-containing solvent phase is removed from the contactor; and a discard stream, comprising water and sand which is substantially free of bitumen oils and solvent, is removed from the contactor at the discharge point. Because of the repeated showering of the tar-sand solids through the solvent phase as those solids move through the contactor, an efficient stripping of the bitumen oils from those solids is effected so that a high extraction rate, which may reach as high as 99.9%, is achievable, while the water layer, in which the sand is contained, keeps the solvent losses low. Preferably, the solvent stream and the tar-sand/water stream move through the contactor in countercurrent.

It is preferred to add water to the tar-sand prior to entry to the contactor so that it may be pumped to the contactor as a slurry. However, the tar-sand may enter the contactor with only a proportion of the total water of the tar-sand and water stream, the remaining water being then introduced independently into the contactor to form that stream. It is advantageous to break up the tar-sand with water in a digester, so that the bitumen oils may be dissolved more readily in the solvent stream.

The amount of water in the feed stream is determined, firstly, by the possible need to pump the tar-sand/water slurry, if formed, to the contactor; secondly, by the need for the tar-sand/water stream to flow reasonably freely through the contactor; and thirdly, by the need to have the sand in the contactor adequately surrounded by water to prevent the solvent coming in contact with the sand, except while the latter is being showered through the former. In practice, it has been found that the water should constitute at least 20%, advantageously over 40%, and preferably 50%, of the tar-sand/water stream on entry, by weight. The amount of water can exceed the stated percentage, but the efficiency of the system demands that a minimum amount of water be used consistent with its required function. Generally, therefore, the percentage is of the order of 50.

The solvent of the solvent stream being less dense than, and substantially immiscible with, water, the solvent and water form two separate phases, and any solvent adhering to the solids on being showered through the contactor is caused rapidly to migrate back to the solvent phase. The solvent in the solvent stream is dependent on the nature of the tar-sand and may be between 10% and 85% by weight of the bitumen oils of the tar-sand. The solvent is therefore preferably present in an amount by weight less than the extracted bitumen oils; it is possible to exceed the figure of 85%, but no significant benefit is achieved thereby and an excessive amount of solvent adversely affects the economy of the solvent recovery stage. Advantageously, the solvent is between 15% and 85% by weight of the bitumen oils, and preferably between 20% and 80%.

The preferred solvent is a hydrocarbon oil or a mixture of such oils and advantageously falls within the boiling range of kerosene (200° C.–295° C.). The solvent may in fact be kerosene, but may alternatively be a fraction of the extracted bitumen oils, having a similar boiling range.

Normally, the solvent stream discharged from the contactor and having the bitumen oils dissolved therein, is passed to a solvent recovery plant, from which the recovered solvent is recycled to the contactor. Alternatively, the solution of the bitumen oils in the solvent may pass to a refining plant, which supplies a product which is suitable as the solvent of the solvent stream entering the contactor.

The bitumen oils component of tar-sand has a mean specific gravity greater than that of water at 20° C., but its specific gravity falls with increasing temperature. The solution of the bitumen oils in the solvent must be lighter than water and the temperature of the feed stream and the solvent are chosen to that end. The temperature of the feed stream, at least at entry to the contactor is preferably between 20° C. and 95° C. and, for better efficiency, may be between 50° C. and 75° C.

Thermal efficiency may be improved by recycling hot water from the discard stream to form the slurry; recycling of water has the further advantage of reducing the volume discharged to the environment. The recycle water stream may also contain water utilised in heat exchangers in a solvent recovery plant.

The contactor is completely filled by the two streams, receptacles within the contactor being rotated to raise the solids of the tar-sand/water stream and shower them through the solvent stream. Thus, the contactor may be a solids/liquid contactor similar to the liquid/liquid contactor described in British patent specification No. 972035, although the buckets are modified to ensure scooping of the solids from the bottom of the contactor. The structure of the contactor may also be modified by rotating the contactor drum as a whole, the receptacles or buckets for effecting showering being carried by, and rotated with, the drum. The axis of the cylindrical contactor does not depart radically from the horizontal, although it may be inclined downwards towards the discharge point at an angle of less than 8° for example, in order to aid the movement of the solids of the tar-sand through the contactor. The supplies of the solvent stream and the tar-sand/water slurry are chosen so that the interface between the solvent phase and the water phase is constant, preferably approximately at the contactor axis.

The contactor should not rotate so rapidly as to agitate the contents unduly and to form an emulsion therein and the speed of rotation should be such that a clear interface between the solvent and water phases is maintained.

The contactor may be externally heated and/or cooled; thus that part of the contactor adjacent the supply point, may be heated in order to reduce the amount of heating of the tar-sand/water slurry prior to entry.

The size of the contactor is dependent on the desired throughput of tar-sand. In a large installation there may be a number of the contactors arranged in parallel.

The invention will be more readily understood by way of example from the following description of a tar-sand solvent extraction process in accordance therewith, reference being made to the accompanying drawings, in which.

Figure 1A:
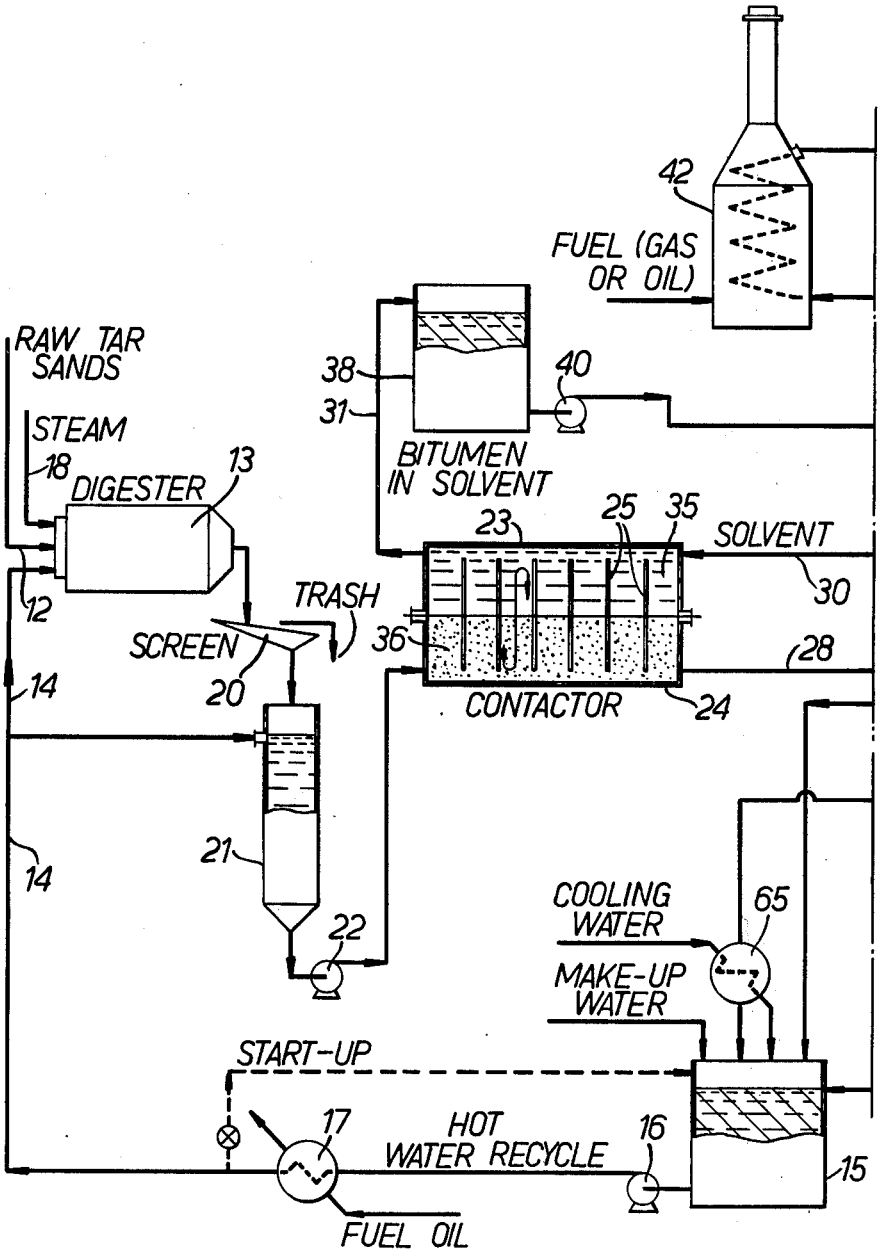
FIG. 1 is a flow diagram of one form of the process.

Raw tar-sand, suitably broken down, is fed at 12 into a rotary digester 13, where it is mixed with hot water through line 14 from a hot water reservoir tank 15 and broken down into slurry form. The recycled water from tank 15 is pumped by a pump 16 through a fuel-fired heater 17 so that the temperature of the water on entry to the digester 13 is about 96° C. Steam may be added to the digester 13 through steam line 18, but normally is not required. The slurry of tar-sand in water exiting from digester 13 flows over a scalping screen 20, which removes foreign bodies. The slurry passes through screen 20 to a head tank 21, where more hot water from recycle line 14 is added as necessary to bring the temperature of the slurry to about 65° C. and to maintain the solids in suspension.

The hot tar-sand/water slurry is pumped by pump 22 from tank 21 to a solids/liquid contactor 23, the slurry entering the contactor near the bottom of the unit.

The contactor 23 is generally as described in British patent specification No. 972035, to which reference should be made, but is modified in minor respects to make it suitable as a solids/liquid contactor. That contactor is shown diagrammatically in axial section in the accompanying FIG. 1 and in radial section in the accompanying FIG. 2, and as illustrated consists of a stationary shell 24 in which a rotor is mounted for rotation about its axis. The rotor includes a number of axially-spaced circular discs 25 which separate the interior of the shell 24 into a series of compartments. The edge of each disc 25 is spaced from the wall of shell 24, so that adjacent compartments are in communication via annular gaps between the discs and shell. In each compartment, there are a series of spaced buckets or receptacles 26 which are carried between the discs of that compartment. Some or all of the buckets have their leading edges extended across the gap between the discs 25 and the shell 24 to act as scrapers and to ensure solids at the bottom of the shell are scooped by the buckets; in FIG. 2, two of the buckets are shown as so extended at 27. The final compartment, i.e. that at the right hand end of the contactor, are not provided with buckets 26, to facilitate removal of the stripped sand.

The hot tar-sand/water slurry enters the contactor 23 as a stream at one end of the contactor, passes progressively from compartment to compartment of the contactor via the circumferential gaps and is discharged as a discard stream through a line 28 at the bottom of the other end of the contactor. At the same time solvent for the bitumen oils of the tar-sand is introduced on line 30 into the top of the contactor 23 as a countercurrent solvent stream and discharges through line 31 at the top of the end of the contactor through which the tar-sand slurry enters. The solvent is pumped by pump 32 from a solvent storage tank 33, and may be heated in a steam heater 34, before entering the contactor 23. The solvent stream being virtually immiscible with water forms a distinct and separate phase above the feed stream; the operation of the system is so arranged that the interface between the two phases remains approximately static at or adjacent the axis of the contactor. That axis does not depart substantially from the horizontal, but may be inclined downwardly at a small angle less than 8° to the horizontal from the entry end to the discharge end of the tar-sand/water stream, in order to assist the flow of the solids of the tar-sand through the contactor.

As the tar-sand/water stream passes through the contactor 23 (from left to right in FIG. 1), it is continuously treated in each compartment by the rotary buckets 26 (FIG. 2), solids of the tar-sand being scooped up and raised by the buckets, and discharged progressively from those buckets in the upper half of the shell 24, so that they are tumbled, or showered, through the solvent stream 35. Being denser than either the solvent or water, the solids discharged from the buckets 26 rapidly pass through the solvent stream 35 and settle at the bottom of the shell 24. The rotary buckets 26 also carry down solvent from stream 35 and into the tar-sand/water stream 36, being discharged as droplets which rapidly return upwardly into the solvent stream 35.

Thus, during the progress of the tar-sand through the contactor 23, the tar-sand particles are first disintegrated, if they have not been so treated prior to entry, and the solids are repeatedly showered through the solvent of the solvent stream in each successive compartment of the contactor, so that the bitumen oils are progressively dissolved in the solvent stream and the sand and fines of the feed stream are progressively stripped of bitumen oils. Finally the sand and fines, without significant bitumen oils, are discharged with water through the discharge line 28.

The contents of the contactor 23 form three phases, the lowermost of which is sand which rapidly settles at the bottom of the container 24, the middle layer being water, in which the sand is located, and the uppermost being solvent. The presence of an enveloping volume of water for the sand has the important function of forming a barrier separating the solvent from the sand and causing rapid displacement of any solvent retained on the sand. The consequence is that, by the time the sand reaches the discharge end of the contactor, it has little or no adhering solvent. The discard stream on line 28 is almost entirely made up of water, sand and fines, while the solvent stream discharge on line 31 consists almost entirely of a solution of the extracted bitumen oils in the solvent. The process performed in the contactor 23 is thus a continuous, countercurrent, multi-stage, extraction.

The bitumen oils solution from the contactor 23 is directed on line 31 to storage tank 38, from which it is passed to a solvent recovery plant which separates the solvent from the bitumen oils and recycles the solvent back to the solvent tank 33. For that purpose, the solution in tank 38 is pumped by pump 40 through a heat exchanger 41, in which the temperature is raised, to a heater 42, which is fired with gas or oil. The solution at a temperature of about 350° C. passes to a fractionating column 43, in which the components of the feed separate in the usual way. Overhead vapour is taken from the column through line 44 to condenser 45, which may be a tubular unit or a direct spray type. The water and light oils condensate from condenser 45 separate in tank 46, the water of the lower layer being recycled to the hot water tank 15 through line 47. The light oils of the upper layer in tank 46 flow to a storage tank 48, and a portion is pumped back through line 50 to the column 43 as reflux, while the remainder is directed to a further tank 51 for bitumen oils, which are pumped to a refinery.

A fraction falling within the kerosene boiling range, e.g. 200° C. to 295° C., is taken as a side-stream from column 43 and passed to a stripper 54, which has steam injected at its base at 55 to drive off the lighter components and to trim the composition of the received solvent fraction. The vaporised lighter components are returned to the column 43, while the trimmed solvent fraction leaves the base of stripper 54, is cooled to about 65° C. in cooler 56, and then flows to the solvent storage tank 33. Solvent tank 33 is also supplied on line 57 with make-up solvent as required. The bottom product of the column 43 — the high boiling point bitumen oils — leaves the bottom of the column and, after cooling in heat exchanger 41, is pumped through a product cooler 58 to the bitumen oils storage tank 51. Warm cooling water from product cooler 58, as well as from heat exchangers 34, 45, and 56 pass via the line 47 to the hot water tank 15.

The solvent fraction obtained from the distillation column 43 and stripped in the stripper 54 contains, not only the recovered solvent, but also fractions of the bitumen oils contained in the tar-sand falling within the same boiling range. Accordingly, the system is self-sufficient in solvent, solvent being required to be supplied externally on line 57, only at start-up. The solvent recovery system is normally operated at atmospheric pressure, but in some circumstances it may be advantageous to operate it under reduced pressure.

The discard stream of sand, fines and water, freed from bitumen oils and solvent, flows on line 28 from contractor 23 to the sand clean-up unit. That unit includes a conical separator 60. Separator 60 is closed and the discard stream entering on line 28 passes through a sleeved section 61, which is designed to eliminate surface turbulence in the water at the top of the separator. The heavier sand rapidly settles into the base of the separator and the water with the fines flows under the sleeve section 61 and over the periphery of the separator into a launder 62. Steam is injected into the base of the separator at 63 close to the valved outlet 64. The steam performs two functions: firstly, it maintains a free flow of sand leaving the separator and, secondly, it effects the removal of any dissolved solvent that may be present in the water. The steam, plus any solvent vapours, leaves the top of the separator 60 and is condensed in condenser 65, hot condensate flowing into the hot water tank 15, together with the warm cooling water. Alternatively, the steam from separator 60 may be condensed in a direct spray condenser.

The water and fines, which overflow from the separator 60 pass from the launder 62 to a centrifugal separator 66, which concentrate the fines into a slurry which is mixed with the sand leaving the valved outlet 64. The water, substantially freed from fines, leaves the centrifugal separator 66 and is returned to hot water tank 15 on line 67. The hot water in tank 15, as above described, is recycled to the digester 13; if some residual solvent is vaporised from the separator 60 into the hot water recycle circuit, it is absorbed and utilised in the contactor 23, and does not represent a loss of solvent in the overall system. The sand from separator 60 and the fines slurry from centrifugal separator 66 have a water content approximately equal to the weight of water plus bitumen oils entering the process in the raw tar-sand. The sand/fines/water effluent on line 68 may therefore be returned to the sand pits without the need for large settling lagoons.

Figure 1B:
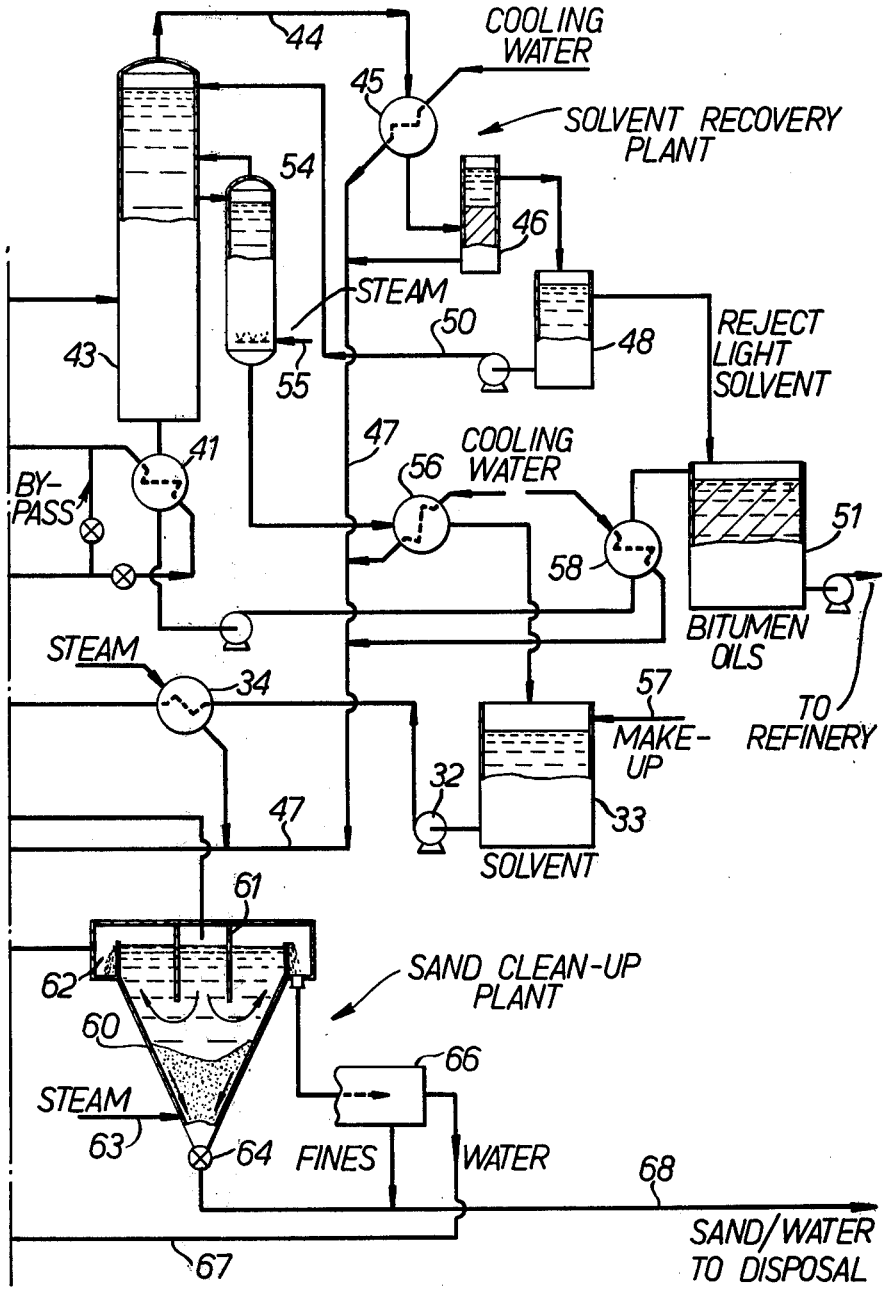
Figure 2:
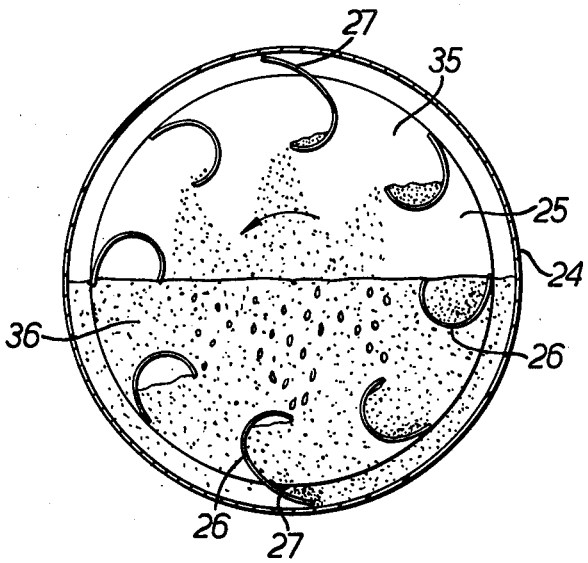
FIG. 2 is a radial section through the contactor used in the process.

Table I gives the mass balance of the system shown in FIG. 1 and described above, and gives the weights, the heat contents and the temperatures of the materials at different points of the system. All quantities are given by weight and it will be observed that the solvent (3.8) is only a small portion of the bitumen oils contained in the tar-sand (19.2). The process is therefore highly economical in solvent usage.

The preferred solvent to be used at start-up is kerosene, the solvent fraction obtained from the distillation column 43 having the same boiling range as kerosene. It is, however, possible to use another solvent, or mixture of solvents, during start-up, the solvent fraction from column 43 being modified as necessary. Suitable solvents, other than kerosene, are hydrocarbon liquids, such as pentane, hexane, heptanes, naphthas, and light oils such as diesel oil, and mixtures thereof. If the chosen solvent is highly volatile, the process is operated under sufficient pressure to maintain it in the liquid phase. It is also possible to employ a start-up solvent, such as one of those listed above, differing from the self-generated solvent derived from the distillation column 43. In that case, the start-up solvent is progressively replaced by the selected side-stream, self-generated, solvent.

Figure 3:
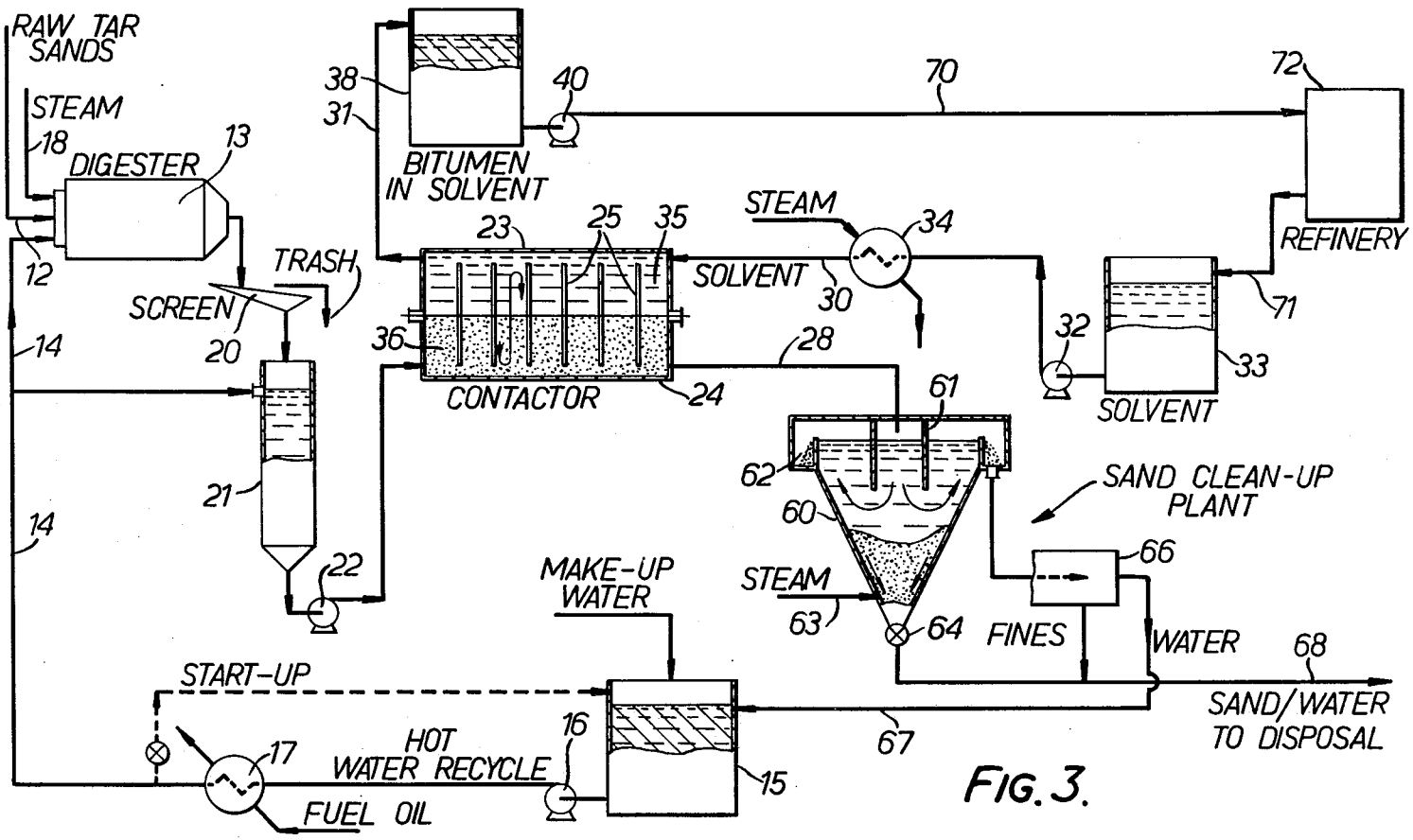
FIG. 3 is a flow diagram illustrating a modification of the process of FIG. 1.

It is not always necessary to provide a solvent recovery plant, exemplified by the distillation column 43 and associated equipment. Indeed, in some cases, it may be economically advantageous not to have the solvent recovery plant, and, instead, to pump the bitumen solution from solution tank 38 to the refinery and to derive fresh solvent from the refinery. That arrangement is illustrated in FIG. 3 which shows a system substantially identical with that of FIG. 1, apart from the omission of the solvent recovery plant. The refinery is indicated schematically at 72 and receives the bitumen oils solution from tank 38 via line 70. The refinery 72 produces as a by-product suitable solvent by normal processing methods and that solvent is fed to the solvent tank 33 on line 57. The solvent from the refinery is not immediately recovered as such, as a first step in the refining process, but may be produced as a commercial product downstream in the up-grading process after preliminary treatment such as hydrocracking. The solvent thus supplied to the extraction process is effectively fresh solvent.

Table II is a mass balance, given by way of example, of the process of FIG. 3.

TABLE I

| | Sand | Fines | Water | Bitumen Oils | Solvent | Steam | Fuel (FOE) | Total Mass | Total Heat Content | Temperature °C. |
|---|---|---|---|---|---|---|---|---|---|---|
| Raw Tar Sands on line 12 | 124.8 | 8.0 | 8.0 | 19.2 | | | | 160.0 | 43 | 10 |
| Hot Water from heater 17 | | | 80.0 | | | | | 80.0 | 768 | 96 |
| Total cooling water to heat exchangers 45, 56, 58 and 65 | | | 18.1 | | | | | 18.1 | 18 | 10 |
| Total of cooling water from 45, 56, 58 and 65, plus condensate from 46, 34 and 65 | | | 20.0 | | | | | 20.0 | 164 | 82 |
| Recycled water on line 67 | | | 60.0 | | | | | 60.0 | 390 | 65 |
| Make-up water to tank 15 | | | Negligible | | | | | | | |
| Steam to digester 13 | | | | | | Negligible | | | | |
| Steam on line 55 | | | | | | 1.9 | | 1.9 | 125 | 145 |
| Steam to heater 34 | | | | | | Negligible | | | | |
| Steam on line 63 | | | | | | Negligible | | | | |
| Fuel to heater 17 | | | | | | | 0.32 | 0.32 | 325 | — |
| Fuel to heater 42 | | | | | | | 0.16 | 0.16 | 162 | — |
| Recycled solvent to tank 33 | | | | | 3.8 | | | 3.8 | 12 | 65 |
| Solvent to contactor on line 30 | | | | | 3.8 | | | 3.8 | 12 | 65 |
| Make-up solvent on line 57 | | | | | — | | | | | |
| Bitumen/solvent from contactor 23 | | 0.8 | | 19.2 | 3.8 | | | 23.8 | 76 | 65 |
| Bitumen oil from tank 51 to refinery | 0.8 | | 19.2 | | | | 20.0 | 20.0 | 68 | 70 |
| Tar sands slurry to contactor 23 | 124.8 | 8.0 | 88.0 | 19.2 | | | | 240.0 | 800 | 65 |
| Contactor discharge on line 28 | 124.8 | 7.2 | 88.0 | | | | | 220.0 | 735 | 65 |
| Discharge from bottom of 60 | 124.8 | 2.5 | 12.5 | | | | | 139.8 | 239 | 65 |
| Discharge to centrifuge 66 | | 4.7 | 75.5 | | | | | 80.2 | 496 | 65 |
| Fines discharge from 66 | | 4.7 | 15.5 | | | | | 20.2 | 107 | 65 |
| Sand/water on line 68 to disposal | 124.8 | 7.2 | 28.0 | | | | | 160.0 | 346 | 65 |

TABLE II

| | Sand | Fines | Water | Bitumen Oils | Solvent | Steam | Fuel (FOE) | Total Mass | Total Heat Content | Temperature °C. |
|---|---|---|---|---|---|---|---|---|---|---|
| Raw tar sands to digester 13 | 124.8 | 8.0 | 8.0 | 19.2 | | | | 160.0 | 43 | 10 |
| Hot water from heater 17 | | | 80.0 | | | | | 80.0 | 768 | 96 |
| Recycled water on line 67 | | | 60.0 | | | | | 60.0 | 360 | 65 |
| Make-up water to tank 15 | | | 20.0 | | | | | 20.0 | 20 | 10 |
| Steam to digester 13 | | | | | | Negligible | | | | |
| Steam to heater 34 | | | | | | 0.2 | | 0.2 | 13 | 145 |
| Steam on line 63 | | | | | | Negligible | | | | |
| Fuel to heater 17 | | | | | | | 0.5 | 0.5 | | 10 |

TABLE II-continued

| | Sand | Fines | Water | Bitumen Oils | Solvent | Steam | Fuel (FOE) | Total Mass | Total Heat Content | Temperature °C. |
|---|---|---|---|---|---|---|---|---|---|---|
| Solvent to contactor on line 30 | | | | | 3.8 | | | 3.8 | 12 | 65 |
| Solvent from refinery on line 71 | | | | | 3.8 | | | 3.8 | 2 | 10 |
| Bitumen/solvent from contactor 23 | | 0.8 | | 19.2 | 3.8 | | | 23.8 | 77 | 65 |
| Bitumen/solvent on line 70 to refinery | | 0.8 | | 19.2 | 3.8 | | | 23.8 | 77 | 65 |
| Tar Sands slurry to contactor 23 | 124.8 | 8.0 | 88.0 | 19.2 | | | | 240.0 | 800 | 65 |
| Contactor discharge on line 28 | 124.8 | 7.2 | 88.0 | | | | | 220.0 | 735 | 65 |
| Discharge from bottom of 60 | 124.8 | 2.5 | 12.5 | | | | | 139.8 | 239 | 65 |
| Discharge to centrifuge 66 | | 4.7 | 75.5 | | | | | 80.2 | 496 | 65 |
| Fines discharge from 66 | | 4.7 | 15.5 | | | | | 20.2 | 107 | 65 |
| Sand/water on line 68 to disposal | 124.8 | 7.2 | 28.0 | | | | | 160.0 | 346 | 66 |

What I claim as my invention and desire to secure by Letters Patent is:

1. A continuous process for the solvent extraction of bitumen oils from tar-sand, comprising the steps of:

(a) supplying tar-sand at a supply point to a contactor and passing said tar-sand from said supply point towards a discharge point from said contactor;

(b) passing a stream of solvent through said contactor, said solvent being of lesser density than, and substantially immiscible with, water;

(c) supplying water to and withdrawing water from said contactor;

(d) said solvent stream and said water providing a solvent phase and a water phase in said contactor substantially distinct from each other, and said contactor being substantially filled by said solvent phase, said water phase and solids of said tar-sand with a barrier layer formed by said water phase between said solvent phase and solids;

(e) repeatedly showering solids of said tar-sand through said liquid phases in said contactor as the tar-sand passes through the contactor towards said discharge point, whereby said solids are contacted with said solvent phase and bitumen oils are progressively dissolved in said solvent phase;

(f) removing a bitumen oils-containing solvent phase from said contactor; and (g) removing a discard stream at said discharge point, said discard stream comprising said withdrawn water and sand which is substantially free of bitumen oils and solvent.

2. A continuous process for the solvent extraction of bitumen oils from tar-sand, comprising the steps of:

(a) passing a stream of tar-sand and water to and through a closed contactor towards a discharge point from said contactor;

(b) passing a stream of solvent through said contactor, said solvent being of lesser density than, and substantially immiscible with, water;

(c) said solvent stream and said water providing a solvent phase and a water phase in said contactor substantially distinct from each other, and said contactor being substantially filled by said solvent phase, said water phase and solids of said tar-sand with a barrier layer formed by said water phase between said solvent phase and solids at the bottom of said contactor;

(d) repeatedly showering solids of said tar-sand through said liquid phases in said contactor as the tar-sand passes through the contactor towards said discharge point, whereby said solids are contacted with said solvent phase and bitumen oils are progressively dissolved in said solvent phase;

(e) removing a bitumen oils-containing solvent phase from said contactor; and (f) removing a discard stream at said discharge point, said discard stream comprising water and sand which is substantially free of bitumen oils and solvent.

3. A process as claimed in claim 2, further comprising forming a slurry of tar-sand in water and continuously feeding said slurry to a supply point of said contactor to form said tar-sand and water stream.

4. A process as claimed in claim 2, in which water constitutes at least 20% by weight of said tar-sand and water stream.

5. A process as claimed in claim 2, in which water constitutes at least 40% by weight of said tar-sand and water stream.

6. A process as claimed in claim 5, in which water constitutes about 50% by weight of said tar-sand and water stream.

7. A process as claimed in claim 2, in which said solvent is at least 10% by weight of the bitumen oils of the tar-sand.

8. A process as claimed in claim 7, in which the solvent is between 10% and 85% by weight of the bitumen oils.

9. A process as claimed in claim 7, in which the solvent is between 20% and 80% by weight of the bitumen oils.

10. A process as claimed in claim 2, in which said tar-sand and water stream and said solvent stream flow in countercurrent through said contactor.

11. A process as claimed in claim 2, in which the temperature of said tar-sand and water stream, at least at entry to said contactor, is between 20° C. and 95° C.

12. A process as claimed in claim 11, in which said temperature is between 50° C. and 75° C.

13. A process as claimed in claim 2, in which said solvent is a hydrocarbon solvent or a mixture of hydrocarbon solvents.

14. A process as claimed in claim 13, in which said solvent or said mixture falls within the boiling range of kerosene.

15. A process as claimed in claim 13, in which said solvent is kerosene.

16. A process as claimed in claim 14, in which said solvent is a fraction distilled from the extracted bitumen oils.

17. A process as claimed in claim 2, in which said bitumen oils-containing solvent phase leaving said contactor is passed to a refining plant, and the refining plant supplies as a product the solvent for said solvent stream.

18. A process as claimed in claim 2, in which said bitumen oils-containing solvent phase is treated in a solvent recovery plant in which the bitumen oils are separated from the solvent which is recirculated to said contactor as a major part at least of said solvent stream.

19. A process as claimed in claim 14, in which said bitumen oils-containing solvent phase is treated in a fractionating column from which a fraction having a boiling range corresponding approximately to that of kerosene is withdrawn and used as said solvent stream.

20. A process as claimed in claim 2, in which some of the water is removed from said discard stream and recirculated to form at least a part of the water of said tar-sand and water stream.

21. A process as claimed in claim 2, in which said contactor is a substantially horizontal contactor having a plurality of stages, in each of which said solids are showered through said liquid phases.

22. A process as claimed in claim 2, in which said solids are showered by buckets rotating in said contactor about an axis which does not differ substantially from the horizontal.

23. A process as claimed in claim 2, in which said contactor comprises a rotary drum carrying buckets for raising said solids and showering them through said liquid phases.

24. A continuous process for the solvent extraction of bitumen oils from tar-sand, comprising the steps of:

(a) forming a pumpable slurry of tar-sand in water;

(b) pumping said slurry to a supply point at one end of a substantially horizontal, closed contactor, and causing said slurry to move through said contactor to a discharge point at the other end of said contactor;

(c) passing a solvent stream through said contactor in countercurrent to said slurry, said solvent stream consisting essentially of a solvent for said bitumen oils, being substantially immiscible with water and having a density less than that of water;

(d) said slurry and said solvent stream substantially filling said contactor and forming three phases, of which the lowermost phase comprises solids of said slurry saturated with water, the uppermost phase comprises said solvent and solute, and an intermediate phase consisting essentially of water and forming a barrier layer between said solids and said uppermost phase;

(e) repeatedly showering said solids through said uppermost phase and said barrier layer as said slurry passes through said contactor towards said discharge point, whereby said solids are contacted with said solvent and said bitumen oils are progressively dissolved in said solvent stream;

(f) removing said solvent stream with dissolved bitumen oils from said contactor;

(g) removing a discard stream at said discharge point, said discard stream comprising water and sand which is substantially free of bitumen oils and solvent;

(h) separating a part of the water of said discard stream; and (i) recycling said separated water to constitute at least a part of said slurry.

25. A continuous process for the solvent extraction of bitumen oils from tar-sand, comprising the steps of:

(a) continuously supplying tar-sand and water to a closed contactor and causing a slurry of said tar-sand and water to pass through said contactor towards a discharge point from said contactor;

(b) passing a stream of solvent through said contactor in countercurrent to said slurry, said solvent being of lesser density than, and substantially immiscible with, water;

(c) said solvent stream and said water providing respectively an upper solvent phase and a lower water phase in said contactor, and said contactor being substantially filled by said solvent phase, said water phase and solids of said tar-sand with a barrier layer formed by said water phase between said solvent phase and solids;

(d) said solvent phase and said water phase having a substantially constant interface;

(e) repeatedly showering solids of said tar-sand through said liquid phases in said contactor as the tar-sand passes through the contactor towards said discharge point, whereby said solids are contacted with said solvent phase and bitumen oils are progressively dissolved in said solvent phase;

(f) continuously removing a bitumen oils-containing solvent phase from said contactors; and (g) continuously removing a discard stream at said discharge point, said discard stream comprising water and sand which is substantially free of bitumen oils and solvent.

26. A continuous process for the solvent extraction of bitumen oils from tar-sand, comprising the steps of:

(a) forming a slurry of tar-sand in water and continuously feeding said slurry to a supply point of a closed contactor;

(b) passing a stream of said slurry through a closed contactor towards a discharge point from said contactor;

(c) passing a stream of solvent through said contactor, said solvent being of lesser density than, and substantially immiscible with, water;

(d) said solvent stream and said water providing a solvent phase and a water phase in said contactor, and said contactor being substantially filled by said solvent phase, said water phase and solids of said tar-sand with a barrier layer formed by said water phase between said solvent phase and solids at the bottom of said contactor;

(e) repeatedly showering solids of said tar-sand through said liquid phases in said contactor as the tar-sand passes through the contactor towards said discharge point, whereby said solids are contacted with said solvent phase and bitumen oils are progressively dissolved in said solvent phase;

(f) removing a bitumen oils-containing solvent phase from said contactor; and (g) removing a discard stream at said discharge point, said discard stream comprising water and sand which is substantially free of bitumen oils and solvent.

* * * * *

UNITED STATES PATENT OFFICE

CERTIFICATE OF CORRECTION

Patent No. 4,160,718 Dated July 10, 1979

Inventor(s) John S. Rendall

It is certified that error appears in the above-identified patent and that said Letters Patent are hereby corrected as shown below:

In Table I, for the line "Bitumen oil from tank 51 to refinery" under the heading "Sand", now reads "0.8", should be blank; under the heading "Fines", now blank, should read --0.8--, under the heading "Water", now reads "19.2", should be blank; under heading "Bitumen Oils," now blank, should read --19.2--; and under the heading Fuel (FOE), now reads "20.0", should be left blank.

In Table II, for the line "Sand/Water on line 68 to disposal" under the heading "Temperature °C," now reads "66", should read --65--.

Signed and Sealed this

*Twelfth* Day of *February 1980*

[SEAL]

*Attest:*

SIDNEY A. DIAMOND

*Attesting Officer* *Commissioner of Patents and Trademarks*